US008002568B2

(12) United States Patent
Searby

(10) Patent No.: US 8,002,568 B2
(45) Date of Patent: Aug. 23, 2011

(54) CONNECTOR FRAME

(75) Inventor: Tom J. Searby, Eaton, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 3 days.

(21) Appl. No.: 12/502,400

(22) Filed: Jul. 14, 2009

(65) Prior Publication Data

US 2011/0014810 A1 Jan. 20, 2011

(51) Int. Cl.
*H01R 13/627* (2006.01)

(52) U.S. Cl. ..... 439/358; 439/352

(58) Field of Classification Search ..... 439/352, 439/358

See application file for complete search history.

(56) References Cited

U.S. PATENT DOCUMENTS

| | | | | |
|---|---|---|---|---|
| 6,261,116 | B1 * | 7/2001 | Ceru | 439/352 |
| 6,544,066 | B2 * | 4/2003 | Fukase | 439/352 |
| 6,568,954 | B2 * | 5/2003 | Endo et al. | 439/489 |
| 6,951,474 | B1 * | 10/2005 | Wu | 439/358 |
| 7,264,496 | B2 * | 9/2007 | Wu | 439/358 |
| 7,399,195 | B2 * | 7/2008 | Kim et al. | 439/352 |

* cited by examiner

*Primary Examiner* — Truc T Nguyen
(74) *Attorney, Agent, or Firm* — Michael S. Czarnecki

(57) ABSTRACT

A connector frame is provided. The connector frame can be a generally rectangular member having a bore formed therethrough. The rectangular member can be at least partially formed by a first wall, and a second wall, connected by two side walls. The first, second and side walls can form at least a portion of an interior surface and an exterior surface. At least a portion of the interior surface can include a plurality of raised features adapted to detachably attach to a cable connector. A plurality of projections adapted to provide a grip for one or more fingers on each of the two side walls can be disposed on the exterior surface of the two side walls.

20 Claims, 4 Drawing Sheets

CONNECTOR FRAME

BACKGROUND OF THE INVENTION

Description of the Related Art

This section is intended to introduce the reader to various aspects of art which may be related to one or more aspects of the present invention as described and claimed below. This discussion is believed helpful in providing the reader with background information, thereby facilitating a better understanding of various aspects of the present invention. Accordingly, it should be understood by the reader that the provided information should be read in this light and not as an admission of any prior art.

Two piece "pin and socket" connectors are ubiquitous throughout industries employing electrical systems and are typically found throughout modern automobiles, aircraft, toys, and computer systems. Pioneered by the Molex Products Company, the two-piece pin and socket connector design has become a de facto electronic standard. The Molex Products Company developed and patented the first examples of this connector style in the late 1950s and early 1960s. First used in home appliances, other industries soon began designing it into their products from automobiles to vending machines to mini-computers.

The term "Molex connector" has been applied to the class of similar pin and socket connectors as the colloquial nom de guerre. Within a two piece pin-and-socket electrical connector, e.g. a Molex connector, one or more cylindrical spring-metal pins fit into one or more corresponding, complimentary, cylindrical spring-metal sockets. The pins and sockets are held in a rectangular matrix in a nylon shell. This style of connector was first used as a computer disk drive power connector in the late 1970s, thereby establishing the preliminary path towards becoming the computing industry standard. A Molex connector requires the user to push either the pin or socket portion of the connector into the other, complimentary, connector to establish continuity through the connection. At times, the ability to apply sufficient force to connect or disconnect a Molex connector can be limited by the tight confines of the device in which the Molex connector is disposed.

SUMMARY OF THE INVENTION

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

A connector frame is provided. The connector frame can be a generally rectangular member having a bore formed therethrough. The rectangular member can be at least partially formed by a first wall, and a second wall, connected by two side walls. The first, second and side walls can form at least a portion of an interior surface and an exterior surface. At least a portion of the interior surface can include a plurality of raised features adapted to detachably attach to a cable connector. A plurality of projections adapted to provide a grip for one or more fingers on each of the two side walls can be disposed on the exterior surface of the two side walls.

A method of connecting a cable is also provided. A connector frame can be disposed about a cable connector which is disposed on at least one end of a cable. The connector frame can be a generally rectangular member having a bore formed therethrough. The rectangular member can be at least partially formed by a first wall, and a second wall, connected by two side walls. The first, second and side walls can form at least a portion of an interior surface and an exterior surface. At least a portion of the interior surface can include a plurality of raised features adapted to detachably attach to a cable connector. A plurality of projections adapted to provide a grip for one or more fingers on each of the two side walls can be disposed on the exterior surface of the two side walls. A force can be applied to the plurality of projections disposed about the exterior surface of the two side walls.

A connector frame system is also provided. The system can include a cable having a cable connector disposed on a first end. The system can further include a connector frame disposed about the cable connector. The connector frame can be a generally rectangular member having a bore formed therethrough. The rectangular member can be at least partially formed by a first wall, and a second wall, connected by two side walls. The first, second and side walls can form at least a portion of an interior surface and an exterior surface. At least a portion of the interior surface can include a plurality of raised features adapted to detachably attach to a cable connector. A plurality of projections adapted to provide a grip for one or more fingers on each of the two side walls can be disposed on the exterior surface of the two side walls. At least a portion of the plurality of raised features disposed on the interior surface of the connector frame can be disposed proximate the cable connector.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Advantages of one or more disclosed embodiments may become apparent upon reading the following detailed description and upon reference to the drawings in which.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Figure 1:
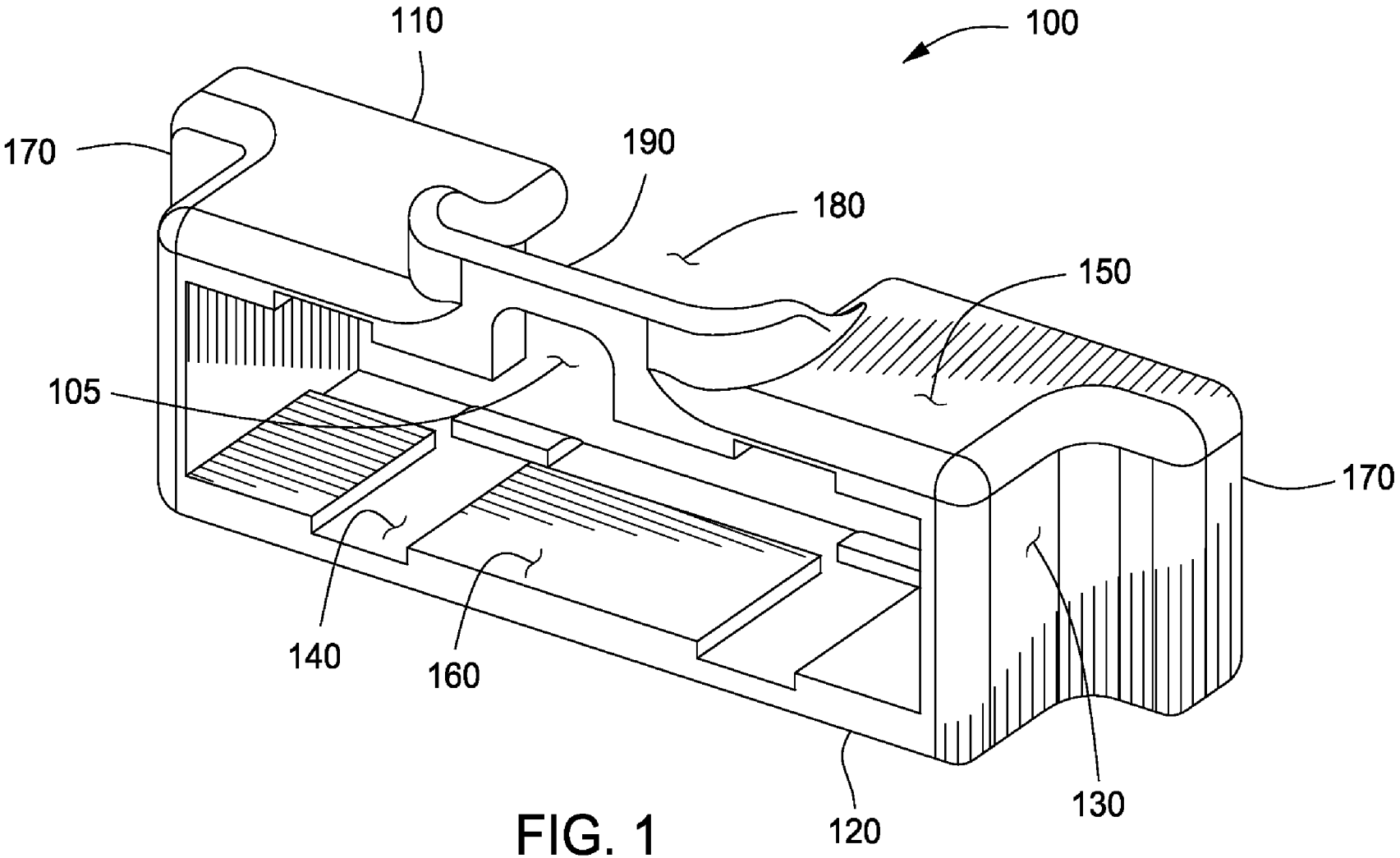
FIG. 1 is a perspective view depicting an illustrative connector frame, according to one or more embodiments described herein.
Figure 2:
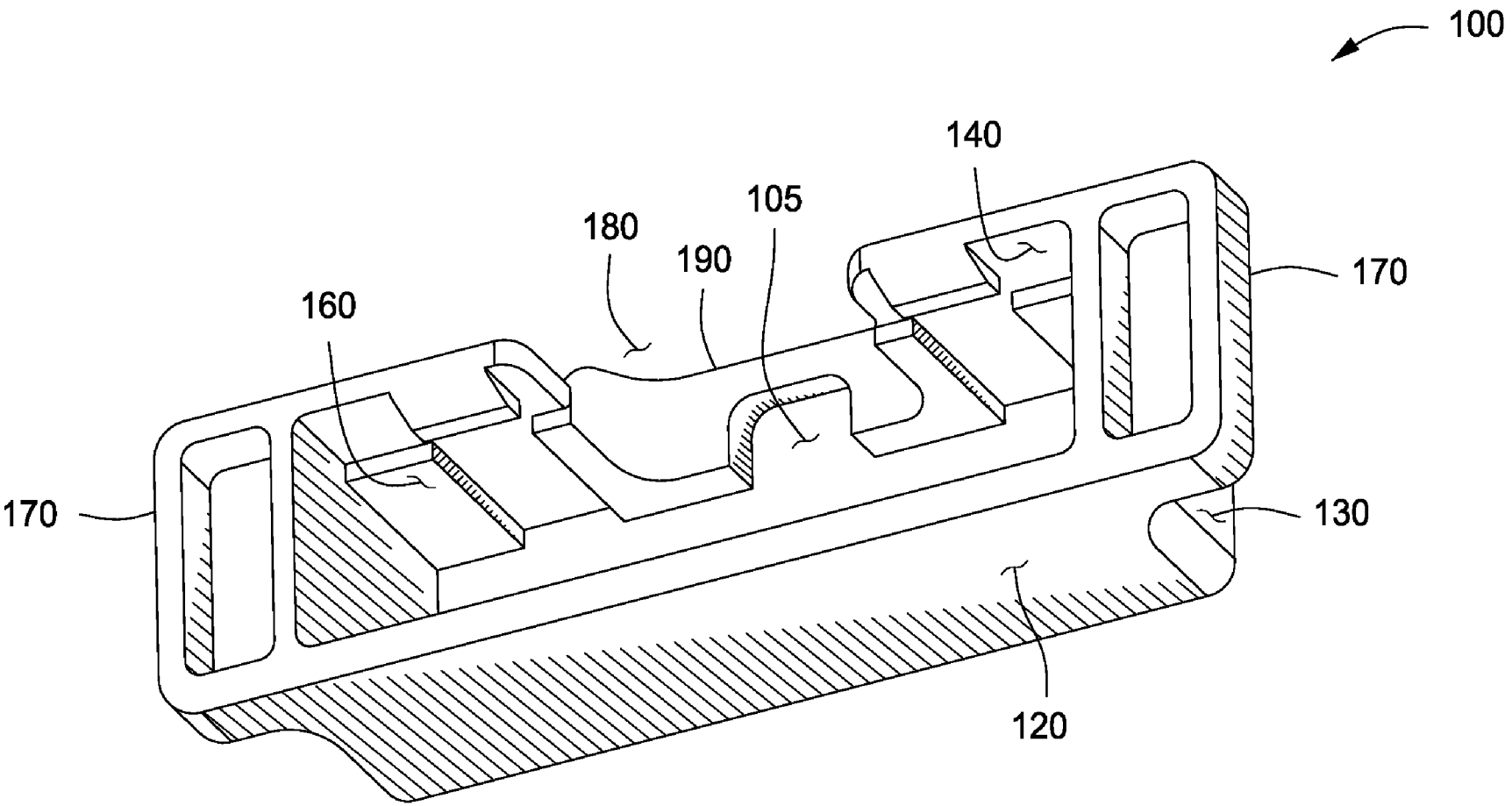
FIG. 2 is another perspective view of the illustrative connector frame depicted in FIG. 1, according to one or more embodiments described herein.

FIG. 1 is a perspective view depicting an illustrative connector frame 100, according to one or more embodiments. FIG. 2 is another perspective view of the illustrative connector frame 100 depicted in FIG. 1, according to one or more embodiments. In one or more embodiments, the connector frame 100 can include first wall 110 and a second wall 120, connected in whole or in part by two side walls 130. The first 110, second 120, and side walls 130 can form a rectangular member having a bore 105 formed therethrough. In one or more embodiments, the first 110, second 120, and side walls 130 can form a rectangular member having an interior surface 140 and an exterior surface 150. In one or more embodiments, one or more surface features 160 can be at least partially disposed on or about the interior surface 140 of the connector frame 100. The one or more surface features 160 can include one or more features suitable for attachment to a cable connector partially or completely inserted within the bore 105 of the connector frame 100. In one or more embodiments, one or more projections 170 can be disposed on or about the exterior surface 150 of the connector frame 100. In one or more embodiments, a notch 180, extending from the interior surface 140 to the exterior surface 150 can be disposed in or about the connector frame 100. In one or more embodiments, a raised lip 190 can be at least partially disposed about the perimeter of the notch 180.

In one or more embodiments, the bore 105 formed by the first 110, the second 120, and the one or more side walls 130 can have a rectangular, square, or trapezoidal shape having any size or proportion. In one or more embodiments, the bore 105 can have a constant cross sectional area across the connector frame 100. In one or more embodiments, the bore 105 can have a tapered, or variable, cross sectional area across the connector frame 100. In one or more specific embodiments, the bore 105 can be rectangular, having a constant cross sectional area across the connector frame 100 as depicted in FIG. 1. In one or more embodiments, the bore 105 can closely approximate or equal one or more exterior surfaces of a modular cable connector, for example a Molex® standard connector, a Molex® Mini-fit™ connector, a Molex® Micro-fit™ connector, a Molex® Mini-fit™ Sr. connector, and a Molex®Sabre connector. By closely approximating or equaling one or more exterior surfaces of a modular cable connector, the connector frame 100 can be disposed about the exterior surface of the cable connector.

In one or more embodiments, one or more surface features 160 can be disposed on or about the interior surface 140 of the cable connector 100. In one or more embodiments, the one or more surface features can 160 be integrally molded or otherwise permanently attached to the cable connector 100. The one or more surface features 160 can include one or more raised features, one or more recessed features, or any combination or number thereof. In one or more embodiments, the one or more surface features 160 can include one or more moveable features, for example one or more bendable or displaceable tabs or latches. In one or more embodiments, all or a portion of the one or more surface features 160 can be suitable for engaging or otherwise interlocking with one or more complimentary features disposed on the exterior surface of a cable connector. By engaging or otherwise interlocking all or a portion of the one or more surface features 160 with the one or more complimentary features disposed on the exterior surface of a cable connector, the connector frame 100 can be detachably or non-detachably attached to the exterior surface of the cable connector.

In one or more embodiments, one or more projections 170 can be disposed on or about the exterior surface 150 of the connector frame 100. The one or more projections 170 can be disposed symmetrically or asymmetrically on or about the exterior surface 150 of the connector frame 100. In one or more embodiments, the one or more projections 170 can disposed on opposing sides of the connector frame 100, for example one or more symmetric projections 170 can be disposed on or about each side wall 130 of the connector frame 100, as depicted in FIGS. 1 and 2. In one or more specific embodiments, the one or more projections 170 can provide sufficient area for a user to apply finger pressure to the connector frame 100.

In one or more embodiments, a notch 180 can be disposed on or about the connector frame 100. In one or more specific embodiments, the notch 180 can extend from the interior surface 140 to the exterior surface 150 of the connector frame 100 as depicted in FIGS. 1 and 2. In one or more specific embodiments, the notch 180 can accommodate one or more features disposed on or about a cable connector partially or completely inserted or otherwise disposed in or within the connector frame. In one or more embodiments, the notch 180 can be partially or completely surrounded about its perimeter by a raised lip 190 extending from the exterior surface 150 of the connector frame 100. All or a portion of the raised lip 190 can project a fixed distance or variable distance from the exterior surface 150 of the connector frame 100. In one or more embodiments, all or a portion of the raised lip 190 can project a variable distance to improve user access to one or more features disposed on or about a cable connector inserted partially or completely within the connector frame 100.

Figure 3:
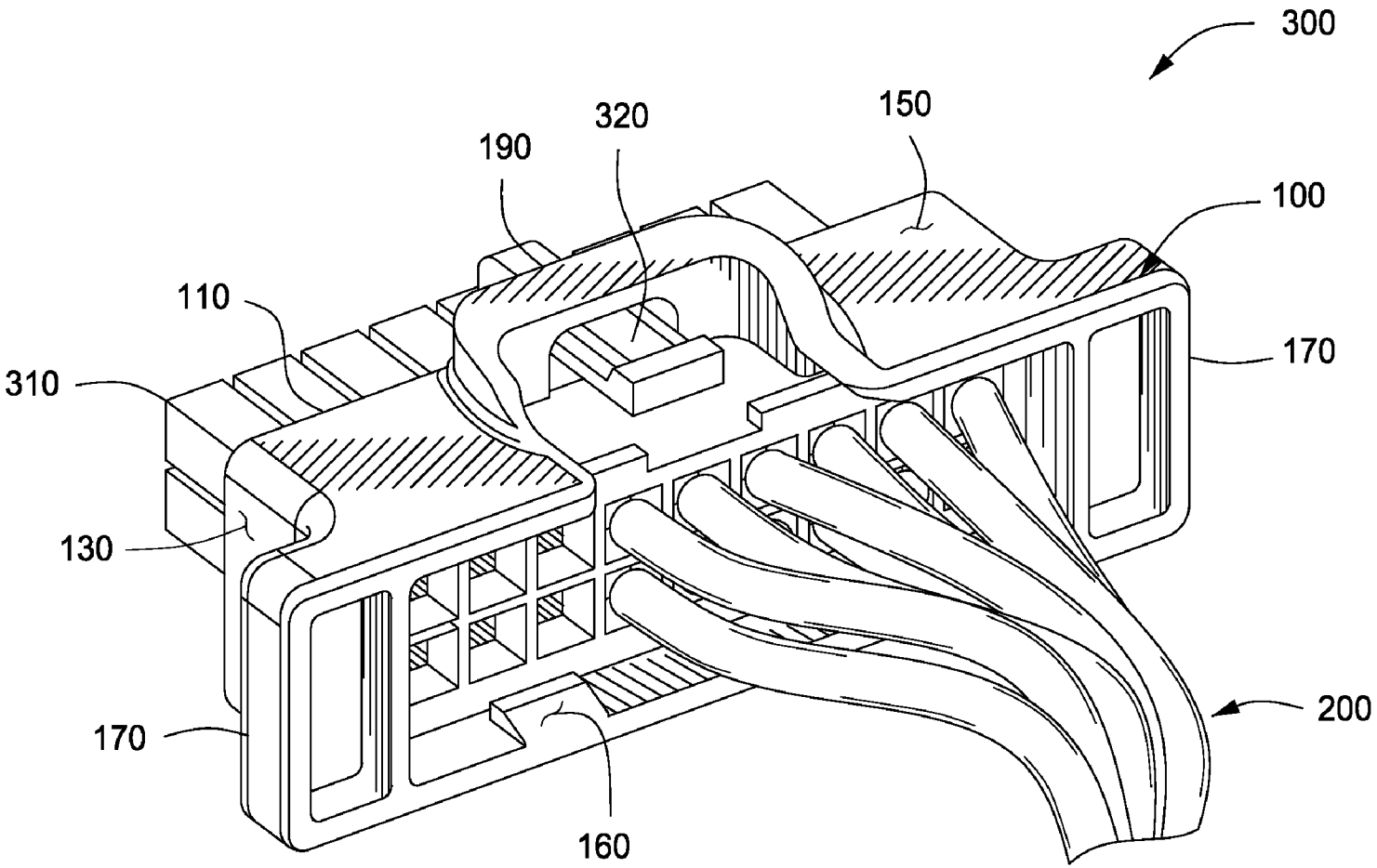
FIG. 3 is a perspective view depicting an illustrative connector frame system, according to one or more embodiments described herein.
Figure 4:
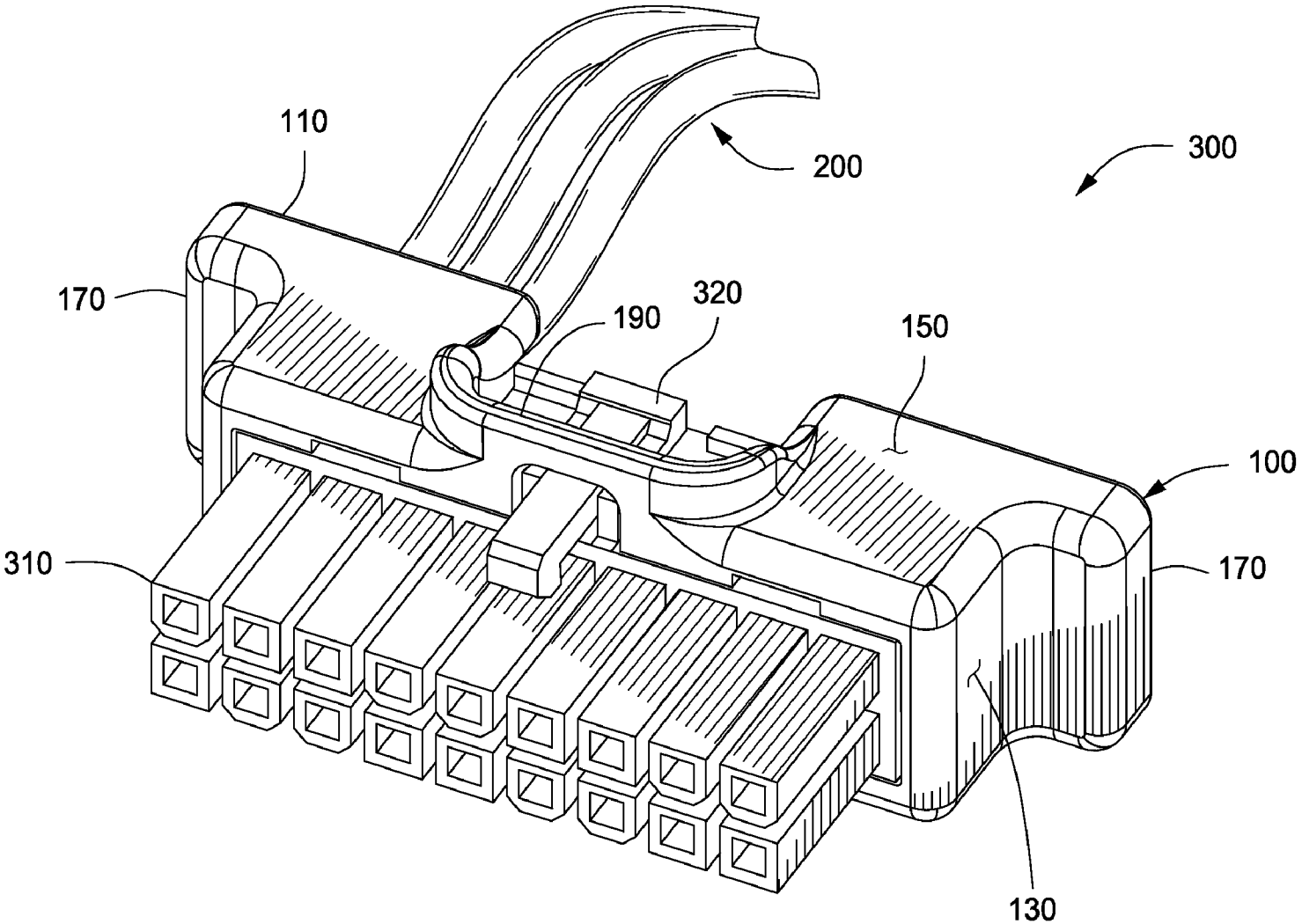
FIG. 4 is another perspective view of the illustrative connector frame system depicted in FIG. 3, according to one or more embodiments described herein.

FIG. 3 is a perspective view depicting an illustrative connector frame system 300, according to one or more embodiments. FIG. 4 is another perspective view of the illustrative connector frame system 300 depicted in FIG. 3, according to one or more embodiments. In one or more embodiments, the connector frame system 300 can include a connector frame 100 disposed partially or completely about a cable connector 310 which is, in turn, disposed on at least one end of a cable 200. One or more cable connector features 320 can be disposed in, on, or about the cable connector 310. In one or more specific embodiments, the one or more connector features can be disposed on an exterior surface of the cable connector 310. In one or more embodiments, one or more cable connector features 320 can be disposed partially or completely within all or a portion of the notch 180 disposed on the connector frame 100.

In one or more embodiments, the cable 200 and the cable connector 310 can contain 2 or more conductors; 4 or more conductors; 8 or more conductors, 12 or more conductors; 18 or more conductors; 24 or more conductors; or 36 or more conductors. In one or more embodiments, the cable 200 and the cable connector 310 can have 2 or more circuits; 3 or more circuits; 4 or more circuits; 5 or more circuits; 6 or more circuits; 9 or more circuits; 12 or more circuits; or 15 or more circuits.

In one or more embodiments, all or a portion of the one or more surface features 160 disposed on or about the interior surface 140 of the connector frame 100 can be disposed proximate the cable connector 310 as depicted in FIGS. 3 and 4. In one or more embodiments, the one or more surface features 160 can detachably or non-detachably attach, interconnect, or interlock the connector frame 100 to the cable connector 310. By attaching, interconnecting or otherwise interlocking the connector frame 100 to the cable connector 310, user manipulation of the cable connector 310 can be facilitated, without requiring the user to grasp or otherwise tension or stress the one or more conductors 210 forming the cable 200.

In one or more embodiments, the one or more cable connector features 320 can include, but are not limited to, one or more latches, clasps, or similar mechanical engagement devices disposed in, on, or about the cable connector 310. In one or more embodiments, the one or more cable connector features 320 can be activated by a user, for example through the application of finger pressure to a latch type connector feature similar to those depicted in FIGS. 3 and 4.

In one or more embodiments, the cable connector 310 can have a plurality of male conductor ("pin") connectors, female conductor ("socket") connectors, or any combination or frequency thereof. In one or more specific embodiments, the cable connector 310 can have a plurality of female conductor connectors arranged symmetrically as depicted in FIGS. 3 and 4. Although an 18-conductor cable connector 310 is depicted in FIGS. 3 and 4, any number of symmetrical or asymmetrical conductors can be similarly accommodated within a single connector frame 100 having appropriate dimensions. In one or more embodiments, one or more pins and one or more sockets can be arranged in any combination in cable connector 310. In one or more embodiments, the current carrying capacity per mated pin and socket can be in the range of about 0 A to about 12 A.

In one or more embodiments, a connector frame 100 can be disposed about, or otherwise attached to, the cable connector 310 by sliding or otherwise disposing the connector frame 100 about the end of the cable connector 310 until all or a portion of the one or more surface features 160 disposed on the interior surface 140 of the connector frame 100 engage all or a portion of one or more features disposed in, on, or about the cable connector 310. In one or more embodiments, the connector frame 100 can be disposed about the cable connector 310 within the typically tight confines found in most modern electronic devices. After the connector frame 100 is disposed about the cable connector 310, a user can apply greater force to the cable connector 310 using finger pressure applied to the one or more projections 170 than could otherwise be applied by applying finger pressure to the cable connector 310 in the absence of the connector frame 100.

In one or more embodiments, the cable 200 can define an axis along which the plurality of conductors 210 forming the cable 200 parallel. After disposing the connector frame 100 about the cable connector 310, the axis will lie parallel to the bore 105 of the connector frame 100. In one or more embodiments, the one or more projections 170 can lie transverse, i.e. at about a 90° angle, to the axis of the cable connector 310. In one or more embodiments, application of a force to the one or more projections 170 along the axis of the cable 200 in a first direction can attach the cable connector 310 to a complimentary cable connector receiver. In one or more embodiments, application of a force to the one or more projections 170 along the axis of the cable 200 in a second direction can detach the cable connector 310 from a complimentary cable connector receiver. In one or more embodiments, one or more cable connector features 320 can be activated by the user to enable the attachment of the cable connector 310 to a complimentary cable connector receiver when the user applies a force in the first direction. In one or more embodiments, one or more cable connector features 320 can be activated by the user can be activated by the user to enable the detachment of the cable connector 310 from a complimentary cable connector receiver when the user applies a force in the second direction.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A connector frame, comprising:

a generally rectangular member haying a bore formed therethrough configured to be slidably disposed about an exterior surface of a modular cable connector:

wherein at least a portion of an interior surface of the bore comprises a plurality of raised features adapted to non-detachably attach the rectangular member to the modular cable connector and to non-movably affix the rectangular member to the modular cable connector when the modular cable connector is assembled to a complimentary modular cable connector; and a plurality of projections disposed on the exterior surface of the rectangular member;

wherein the plurality of projections are adapted to provide a grip for one or more fingers on at least two opposing exterior surfaces of the rectangular member.

2. The connector frame of claim 1, further comprising:

a notch disposed in at least one wall of the rectangular member, the notch extending from the interior surface to the exterior surface of the rectangular member, the notch adapted to accommodate at least one modular cable connector feature when the modular cable connector is at least partially inserted into the bore.

3. The connector frame of claim 2 wherein the at least one modular cable connector feature comprises a retention snap disposed on the modular cable connector.

4. The connector frame of claim 2, further comprising:

a raised collar disposed on the exterior surface of at least one wall of the rectangular member, the raised collar at least partially surrounding the notch disposed in the at least one wall.

5. The connector frame of claim 1 wherein the cable connector comprises a modular cable connector disposed on at least one end of a multi-conductor cable.

6. The connector frame of claim 5 wherein the multi-conductor cable comprises a power cable for a computing device and the modular cable connector comprises a connector adapted to connect to the complimentary modular cable connector disposed on a computer motherboard.

7. The connector frame of claim 6 wherein the modular cable connector is selected from the group of cable connectors consisting of: a Molex® standard connector, a Molex® Mini-fit™ connector, a Molex® Micro-fit™ connector, a Molex® Mini-fit™ Sr. connector, and a Molex® Sabre connector.

8. A method of connecting a cable, comprising:

disposing a connector frame about a modular cable connector disposed on at least one end of a cable;

wherein the connector frame comprises:

a generally rectangular member having a bore formed therethrough configured to be slidably disposed about an exterior surface of a modular cable connector;

wherein at least a portion of an interior surface of the bore comprises a plurality of raised features adapted to non-detachably attach the rectangular member to the modular cable connector and to non-movably affix the rectangular member to the modular cable connector when the modular cable connector is assembled to a complimentary modular cable connector; and a plurality of projections disposed on the exterior surface of the rectangular member;

wherein the plurality of projections are adapted to provide a grip for one or more fingers on at least two opposing exterior surfaces of the rectangular member; and applying a force to the plurality of projections, the force directed along the axis of the cable.

9. The method of claim 8, further comprising activating a cable connector feature while applying the force to the plurality of projections.

10. The method of claim 8 wherein the force is applied in a first direction to attach the modular cable connector to the complimentary modular cable connector.

11. The method of claim 8 wherein the force is applied in a second direction to detach the modular cable connector from the complimentary modular cable connector.

12. The method of claim 8 wherein disposing the connector frame about the modular cable connector comprises:

engaging at least a portion of the plurality of raised features disposed on the interior surface of the bore with at least a portion of a plurality of complimentary features disposed about an exterior surface of the modular cable connector.

13. The method of claim 8 wherein the cable comprises a power cable for a computing device and the modular cable connector comprises the complimentary modular cable connector disposed on an electronic component.

14. The method of claim 9 wherein the cable connector feature comprises a latching device to affix the modular cable connector to the complimentary modular cable connector.

15. A cable connector system, comprising:

a multi-conductor cable having a modular cable connector disposed on a first end;

a connector frame, comprising:

a generally rectangular member having a bore formed therethrough configured to be slidably disposed about an exterior surface of the modular cable connector;

wherein at least a portion of an interior surface of the connector frame comprises a plurality of raised features adapted to non-detachably attach to the modular cable connector and to non-movably affix the rectangular member to the modular cable connector when the modular cable connector is assembled to a complimentary modular cable connector; and a plurality of projections disposed on the exterior surface at least two opposing exterior surfaces of the rectangular member;

wherein the plurality of projections are adapted to provide a grip for one or more fingers on at least two opposing exterior surfaces of the rectangular member;

wherein at least a portion of the plurality of raised features disposed on the interior surface of the connector frame are disposed proximate the modular cable connector.

16. The system of claim 15, further comprising:

a notch disposed in at least one wall of the rectangular member, the notch extending from the interior surface of the member to the exterior surface of the member, wherein the notch is adapted to accommodate at least one modular cable connector feature when the modular cable connector is at least partially inserted into the bore.

17. The system of claim 16 wherein the at least one modular cable connector feature comprises a retention snap.

18. The system of claim 16, further comprising:

a raised collar disposed on the exterior surface of the rectangular member, the raised collar at least partially surrounding the notch disposed in the at least one wall.

19. The system of claim 15 wherein the multi-conductor cable comprises a power cable for a computing device and the modular cable connector comprises a connector adapted to connect to the complimentary modular cable connector disposed on a computer motherboard.

20. The system of claim 19 wherein the modular cable connector is selected from the group of cable connectors consisting of: a Molex® standard connector, a Molex® Mini-fit™ connector, a Molex® Micro-fit™ connector, a Molex® Mini-fit™ Sr. connector, and a Molex® Sabre connector.

* * * * *

UNITED STATES PATENT AND TRADEMARK OFFICE

CERTIFICATE OF CORRECTION

PATENT NO. : 8,002,568 B2
APPLICATION NO. : 12/502400
DATED : August 23, 2011
INVENTOR(S) : Tom J. Searby It is certified that error appears in the above-identified patent and that said Letters Patent is hereby corrected as shown below:

In column 6, line 34, in Claim 1, delete “connector:” and insert -- connector; --, therefor.

Signed and Sealed this
Thirty-first Day of July, 2012

David J. Kappos

David J. Kappos
*Director of the United States Patent and Trademark Office*